US012000647B2

(12) United States Patent
Shin et al.

(10) Patent No.: US 12,000,647 B2
(45) Date of Patent: Jun. 4, 2024

(54) REFRIGERATOR

(71) Applicant: LG Electronics Inc., Seoul (KR)

(72) Inventors: Jung-il Shin, Seoul (KR); Sang-hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 17/639,842

(22) PCT Filed: Jul. 31, 2020

(86) PCT No.: PCT/KR2020/010170
§ 371 (c)(1),
(2) Date: Mar. 2, 2022

(87) PCT Pub. No.: WO2021/045394
PCT Pub. Date: Mar. 11, 2021

(65) Prior Publication Data

US 2022/0325942 A1 Oct. 13, 2022

(30) Foreign Application Priority Data

Sep. 3, 2019 (KR) ..... 10-2019-0109107

(51) Int. Cl.
*F25D 25/02* (2006.01)
*A47B 46/00* (2006.01)
*F25D 25/04* (2006.01)

(52) U.S. Cl.
CPC ..... *F25D 25/024* (2013.01); *F25D 25/027* (2013.01); *F25D 25/04* (2013.01); *F25D 2325/021* (2013.01)

(58) Field of Classification Search
CPC ..... F25D 25/024; F25D 25/027; F25D 25/04; F25D 2325/021; F25D 25/025; F25D 25/02; F25D 23/067; A47B 46/005; A47B 51/00
See application file for complete search history.

(56) References Cited

U.S. PATENT DOCUMENTS 2,926,507 A * 3/1960 Ingolia ..... F25D 23/02 312/274
9,170,043 B2 * 10/2015 Choo ..... F25D 23/00
(Continued)

FOREIGN PATENT DOCUMENTS

CN 109253581 A * 1/2019 ..... F25D 25/025
JP 2003322465 A * 11/2003 ..... A47B 57/06
(Continued)

OTHER PUBLICATIONS

Extended European Search Report in European Appln. No. 20860056.9, mailed on Aug. 1, 2023, 8 pages.

*Primary Examiner* — Kimberley S Wright
(74) *Attorney, Agent, or Firm* — Fish & Richardson P.C.

(57) ABSTRACT

The present disclosure relates to a refrigerator provided with a shelf system in which a shelf located at a high position can be withdrawn to a front lower side so that food can be easily stored or taken out. The shelf system constituting the refrigerator according to the present disclosure includes a shelf on which food is placed, a frame which supports the shelf and is detachably attached to a main body of the refrigerator; multiple links provided on one side of the shelf and configured to support the shelf such that the shelf moves forward/backward or upward/downward or is rotatable; and a guide hole which is formed in the frame and controls a trajectory along which at least one link of the multiple links moves, wherein a rotation center shaft of at least one link of the multiple links moves when the shelf moves.

16 Claims, 11 Drawing Sheets

(56) References Cited

U.S. PATENT DOCUMENTS

| | | | | |
|---|---|---|---|---|
| 9,464,841 | B2 * | 10/2016 | Choo | F25D 23/04 |
| 11,460,240 | B2 * | 10/2022 | Yu | F25D 25/027 |
| 2006/0097613 | A1 | 5/2006 | Lee et al. | |
| 2007/0176528 | A1 * | 8/2007 | Lee | F25D 25/02 312/408 |
| 2010/0283368 | A1 * | 11/2010 | Lee | F25D 23/04 312/405.1 |
| 2014/0125212 | A1 * | 5/2014 | Choo | F25D 23/028 312/405.1 |
| 2014/0239789 | A1 * | 8/2014 | Rehage | A47B 88/70 312/334.1 |
| 2018/0325286 | A1 * | 11/2018 | Welk | A47B 96/025 |
| 2020/0217582 | A1 * | 7/2020 | Yu | F25D 25/027 |

FOREIGN PATENT DOCUMENTS

| | | |
|---|---|---|
| KR | 10-2011-0084689 | 7/2011 |
| KR | 10-2011-0088636 | 8/2011 |

* cited by examiner

REFRIGERATOR

CROSS-REFERENCE TO RELATED APPLICATIONS

This application is a National Stage application under 35 U.S.C. § 371 of International Application No. PCT/KR2020/010170, filed on Jul. 31, 2020, which claims the benefit of Korean Patent Application No. 10-2019-0109107, filed on Sep. 3, 2019. The disclosures of the prior applications are incorporated by reference in their entirety.

TECHNICAL FIELD

The present disclosure relates generally to a refrigerator. More particularly, the present disclosure relates to a refrigerator provided with a shelf system in which a shelf located at a high position can be withdrawn to a front lower side so that food can be easily stored or taken out.

BACKGROUND ART

Generally, a device used to store food at a low temperature to prevent the spoilage or deterioration the food is called a refrigerator.

Such a refrigerator is gradually increasing in size and diversifying in function day by day. That is, in order to increase the storage capacity of the refrigerator, the height, width, and depth of the refrigerator is increasing.

Due to the increase of the storage capacity of the refrigerator, the refrigerator is disclosed to have height corresponding to a user's height or to have height higher than a user's height.

However, as the height and depth of the refrigerator increases, the storage capacity thereof increases, but it becomes difficult for a user to store or take out food in a high or deep place of the refrigerator.

Accordingly, recently, as in Korean Patent Application Publication No. 10-2004-0106385, the shelf located at the upper end of a refrigerator is configured to be withdrawn forward.

However, in such a conventional technology, the shelf is provided with multiple parts such that the shelf moves downward after moving forward and thus the weight of the front part of the shelf increases, so the shelf is limited to storing a small amount of food or light food.

Furthermore, in such a configuration, parts such as a link (an arm) are mounted on the front of a sliding rail, and thus it is impossible to store a large amount of food in the shelf due to the forward concentration of weight, and when the shelf is withdrawn forward, the shelf is not easily restored to an initial position thereof.

In addition, in the structure of the conventional technology, in order to maintain a state in which the shelf is received in the refrigerator or withdrawn therefrom, a separate locking device is required.

DISCLOSURE

Technical Problem

Accordingly, the present disclosure has been made to solve the above problems occurring in the prior art, and provides a refrigerator provided with a shelf system which has a simple structure and is configured to facilitate the forward/backward and upward/downward movements of a shelf located at the upper end part of the shelf system.

Furthermore, the present disclosure provides a refrigerator in which the shelf is structurally prevented from automatically moving in a state in which the shelf is received in the refrigerator or withdrawn therefrom such that the stability of the use of the shelf is increased.

In addition, the present disclosure provides a refrigerator in which when the shelf is withdrawn forward or is received backward, the rotation center shaft of a link is simultaneously moved to facilitate the movement of the shelf and the structure of the shelf is simplified.

Technical Solution

In order to accomplish the above objectives, according to an aspect of the present disclosure, in a refrigerator according to the present disclosure, the rotation center shaft of a link which supports a shelf may be configured to be moved when the shelf moves.

In addition, in the refrigerator according to the present disclosure, a damper may be installed to have a locking function. Accordingly, a separate locking device may not be required, and thus a simple structure of the refrigerator may stably support the shelf.

According to the present disclosure, the link which supports the shelf may move forward/backward and upward/downward directions along the guide hole. Accordingly, the shelf may move along an accurate trajectory thereof.

The refrigerator according to the present disclosure includes: a main body having at least one storage space defined therein; a door mounted rotatably to a front surface of the main body and configured to shield the storage space defined inside the main body; and a shelf provided inside the main body and configured to store food, wherein during withdrawal of the shelf, the shelf moves forward and downward while being rotated downward by a shelf system.

In addition, in the shelf system, a rotation center shaft of a link which supports the shelf may be configured to move during the movement of the shelf.

The shelf system of the refrigerator according to the present disclosure may include: a frame which supports the shelf and is detachably attached to the main body of the refrigerator; multiple links provided on one side of the shelf and configured to support the shelf such that the shelf moves forward/backward or upward/downward or is rotatable; and a guide hole which is formed in the frame and controls a trajectory along which at least one link of the multiple links moves, wherein a rotation center shaft of at least one link of the multiple links may move when the shelf moves.

The refrigerator may further include: a damper provided at a side of the frame such that the damper is connected rotatably to any one of the multiple links at an end of the damper, the damper being configured to facilitate the rotation of the shelf and having a locking function.

The multiple links may include: a front link connected rotatably to a front part of the shelf at an end thereof; a rear link connected rotatably to a rear end part of the shelf at an end thereof; and a connection link connected rotatably to the rear link and the front link at opposite ends thereof.

The guide hole may include: a first guide hole which controls forward/backward and upward/downward movements of the connection link; a second guide hole which controls forward/backward and upward/downward movements of the rear link; and a shaft guide hole which controls the forward/backward and upward/downward movements of the connection link and the rear link.

A first connection shaft may be provided on a front end of the connection link such that the front link and the connection link are connected rotatably to each other, and a second connection shaft may be provided on a rear end of the connection link such that the rear link and the connection link are connected rotatably to each other.

The guide hole may include a horizontal part formed horizontally in a front-to-rear direction, and a curvature part having a curvature curved gradually downward from the front end of the horizontal part.

The first guide hole may be formed in the lower part of the frame, and a first guide shaft may be formed on the connection link by protruding laterally therefrom so as to move along the first guide hole.

The second guide hole may be formed in the upper part of the frame, and a second guide shaft may be formed on the rear link by protruding laterally therefrom so as to move along the second guide hole.

The shaft guide hole may be formed in the middle part of the frame, and the second connection shaft may move by being received in the shaft guide hole.

The damper may be connected rotatably to the rear link at a first end thereof, and may be connected rotatably to the frame at a second end thereof.

A damper connection end may be provided on the first end of the damper such that the damper is connected rotatably to the rear link, the damper connection end comprising a connection part connected rotatably to the damper at an end thereof, and a fixed part configured to be integrated with the connection part and fixed to the rear link.

When the shelf is received in the refrigerator, an angle formed between the connection part and a longitudinal direction of the damper may be an acute angle When the shelf is withdrawn toward a front side of the refrigerator, a rear angle formed between the connection part and the longitudinal direction of the damper may be smaller than a front angle formed therebetween.

Advantageous Effects

The refrigerator according to the present disclosure may have the following effects.

First, according to the refrigerator of the present disclosure, the shelf located on the upper end of the inside of the refrigerator may be withdrawn forward and then may rotate downward. Accordingly, even a user with a short height may store food at the rear side of the upper end of the refrigerator, thereby realizing the efficient use of the entire space of the refrigerator.

In addition, according to the refrigerator of the present disclosure, the rotation center shaft of the link which supports the shelf may be configured to move during the movement of the shelf. Accordingly, the movement of the shelf may be efficiently and smoothly performed.

Furthermore, according to the refrigerator of the present disclosure, the damper may be installed to have a locking function. Accordingly, the refrigerator may not require a separate locking device, thereby realizing a simple structure to reduce manufacturing costs and to stably support the shelf.

Additionally, according to the present disclosure, the link which supports the shelf may move forward/backward and upward/downward directions along the guide hole. Accordingly, the shelf may move along an accurate trajectory thereof, thereby preventing the shaking of food stored on the shelf.

MODE FOR INVENTION

Hereinafter, a refrigerator according to the present disclosure will be described in detail with reference to the accompanying drawings.

Figure 1:
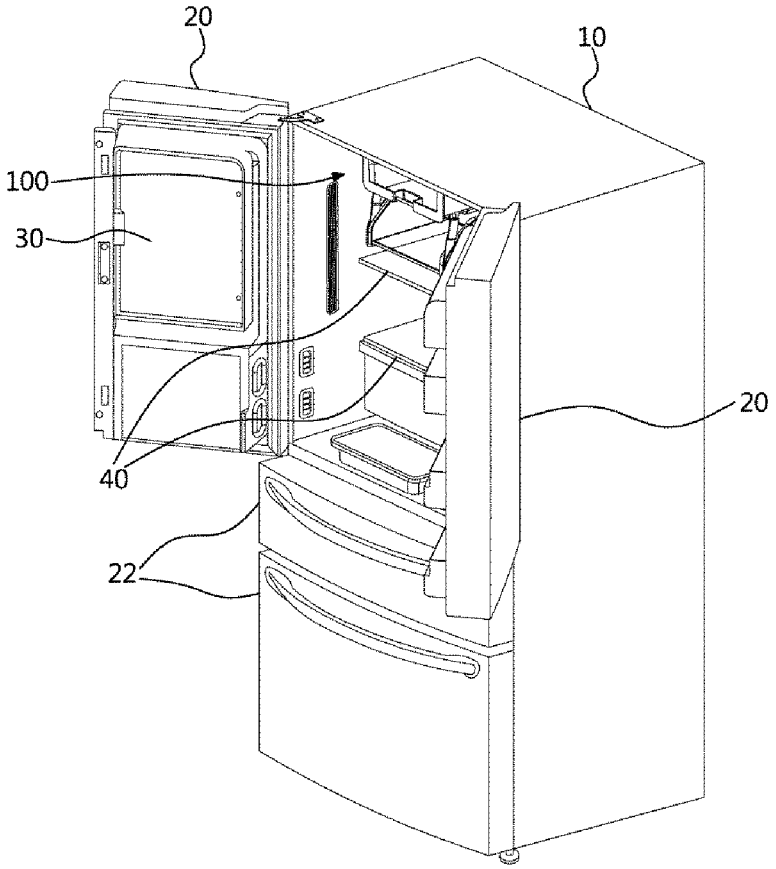
FIG. 1 is a perspective view of a refrigerator according to an exemplary embodiment of the present disclosure.

In FIG. 1, an example of the refrigerator according to the present disclosure is illustrated as a perspective view.

As illustrated in the drawing, in the refrigerator, a main body having at least one storage space formed therein 10 may constitute the entire frame of the refrigerator, and doors 20 and 22 configured to shield the storage space may be installed on the front surface of such a main body 10, wherein the door 20 may be installed to be rotatable.

The doors 20 and 22 may be installed to correspond to the number of storage spaces partitioned from each other and may be generally divided into a refrigerating compartment door 20 and a freezer compartment door 22.

The freezer compartment door 22 may shield a freezer compartment normally provided at a lower side, and the refrigerating compartment door 20 may shield a refrigerating compartment provided at an upper side as illustrated in FIG. 1.

An ice maker 30 may be installed in the refrigerating compartment door 20, and multiple shelves 40 may be provided inside the main body 10 so as to store food.

The multiple shelves 40 may be configured to have various shapes to facilitate the storage of food. Accordingly, hereinafter, each of the shelves 40 installed inside the main body 10 will be described by using the same reference numeral regardless of the installation location of the shelf 40.

Meanwhile, a shelf 40 provided at the highest end of the inside of the refrigerator may be located at a relatively high position and at a position deep in refrigeration space. Accordingly, when the shelf 40 is withdrawn forward by a shelf system 100, the shelf 40 may be configured to move forward and downward while rotating downward. That is, when withdrawing the shelf 40 located at the upper end of the inside of the refrigerator, first, the shelf 40 may be withdrawn forward, and next may be rotated downward In addition, in such a shelf system 100, the rotation center shaft of a link which supports the shelf 40 may be configured to be moved when the shelf moves. In addition, in the shelf system 100, a damper 160 to be described later may be installed to have a locking function such that a separate locking device is not required.

The configuration and operation of the shelf system 100 will be described in detail below.

Figure 8:
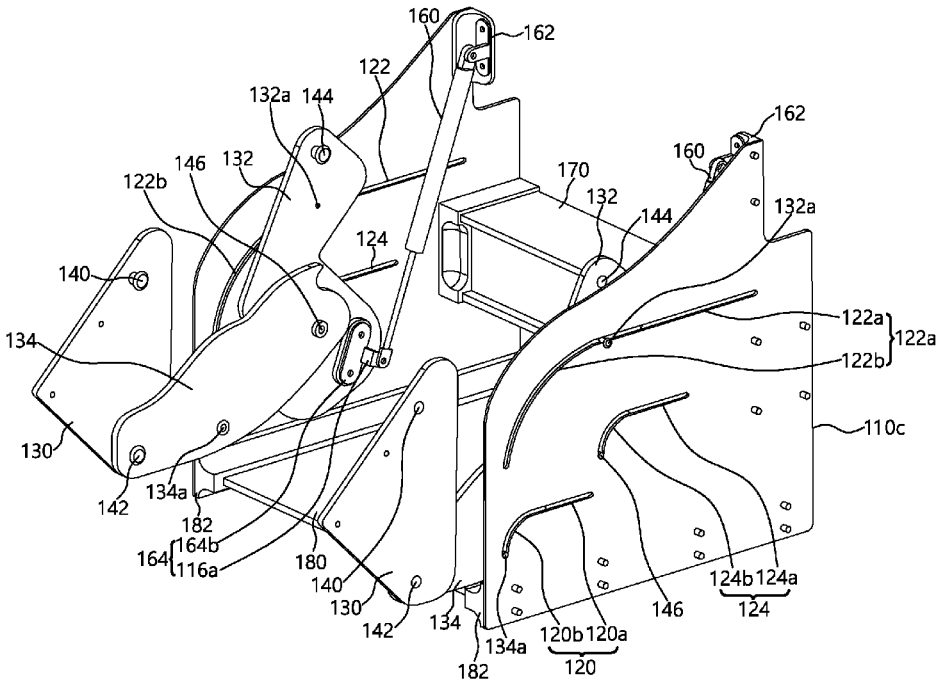
FIG. 8 is a partial perspective view illustrating the state of the link in FIG. 7.
Figure 9:
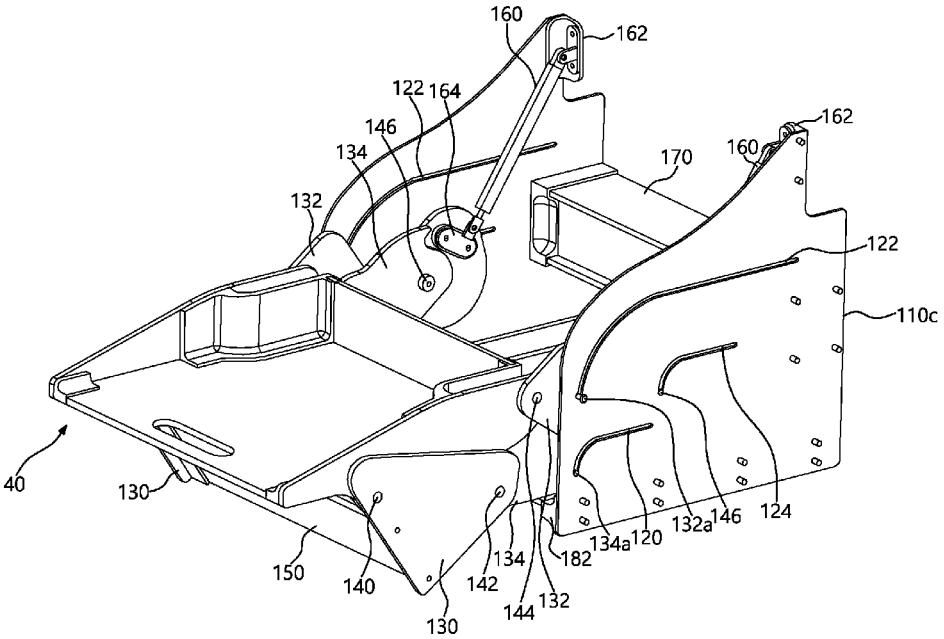
FIG. 9 is a perspective view illustrating a state in which the shelf constituting the refrigerator is withdrawn forward according to the embodiment of the present disclosure.

In FIGS. 2 to 11, the configuration of the shelf system of the refrigerator according to the present disclosure is illustrated in detail. That is, FIGS. 2 and 3 respectively illustrate a perspective view and an exploded perspective view illustrating the configuration of the shelf system constituting the refrigerator according to the exemplary embodiment of the present disclosure, FIGS. 4 and 5, and FIG. 6 respectively illustrate partial perspective views and a sectional view illustrating the states of the link and the shelf while the shelf constituting the refrigerator is received in the refrigerator according to the embodiment of the present disclosure, and FIGS. 7 and 8 respectively illustrate the perspective view illustrating that the shelf constituting the refrigerator is being withdrawn forward according to the embodiment of the present disclosure and the partial perspective view of the state of the link in FIG. 7. In addition, FIG. 9 illustrates a perspective view illustrating a state in which the shelf constituting the refrigerator is withdrawn forward according to the embodiment of the present disclosure, and FIGS. 10 and 11 respectively illustrate a partial perspective view and a partial sectional view illustrating the states of the link, the shelf, and the damper in FIG. 9.

As illustrated in these drawings, the shelf system 100 of the refrigerator may include the shelf 40 on which food is placed, the frame 110 which supports the shelf 40, multiple links 130, 132, and 134 which support the shelf 40 such that the shelf 40 moves forward/backward or upward/downward or is rotatable, and a guide hole 120, 122, or 124 formed in the frame 110 and configured to control a trajectory along which at least one link 130, 132, or 134 of the multiple links 130, 132, and 134 moves.

The shelf 40 may be located inside the refrigerator and may support food to be placed thereon, and may have various shapes.

As for the structure of the shelf 40 as an example used in the refrigerator of the present disclosure, the shelf 40 may include a bottom plate 42 having a rectangular plate shape, a pair of side plates 44 formed by vertically extending upward respectively from the opposite ends of the bottom plate 42, and a rear plate 46 formed by vertically extending upward from the rear end of the bottom plate 42.

Figure 2:
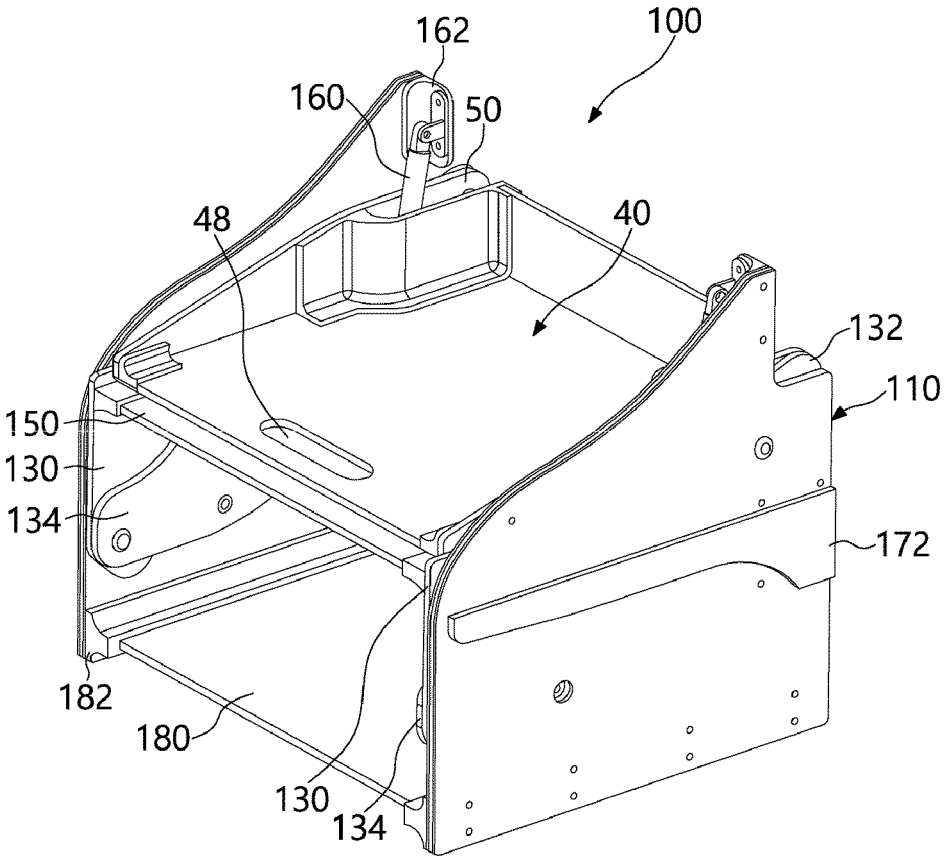
FIG. 2 is a perspective view illustrating the configuration of a shelf system constituting the refrigerator according to the embodiment of the present disclosure.

The shelf 40 may be further provided with a handle 48 held by a user's hand such that the handle is easily pulled or pushed forward or backward. That is, as illustrated in FIG. 2, the handle 48 may be configured to have the shape of a hole formed vertically through the center of the front end part of the bottom plate 42. Accordingly, a user may pull the shelf 40 by putting the user's finger in the handle 48.

The handle 48 may be formed in various shapes. That is, in the embodiment described above, the handle 48 is illustrated to have the shape of a hole formed vertically through the bottom plate, but may have various shapes which allow a user to hold the handle 48 with the hand such that the user can pull the shelf 40 forward.

The shelf 40 may further include a damper groove 50 formed at a rear end part thereof. The damper groove 50 may be a part in which the upper end part of the damper 160 to be described later is received to be rotatably installed. The damper groove 50 may be formed in each of the rear end parts of the opposite plates 44 of the shelf 40, and is preferably configured to have a "U" shape (when viewed from the upper side) having an open rear portion.

Each of a front shaft hole 44*a* and a rear shaft hole 44*b* may be formed through each of the opposite plates 44 in a left-to-right direction.

The front shaft hole 44*a* may be a hole in which a first shelf shaft 140 to be described later passes to be received, and the rear shaft hole 44*b* may be a hole in which a second shelf shaft 144 to be described later passes to be received.

The frame 110 may include a pair of frames spaced apart by a predetermined distance from each other in a horizontal direction so as to support the opposite sides of the shelf 40. The frame 110 may be installed at each of the opposite sides of the shelf 40 and preferably includes at least two frames.

The frames 110 may be provided to be symmetrical to each other at the opposite sides of the shelf 40 and may include a main frame 110*a* which supports the shelf 40 such that the shelf 40 is movable, a cover frame 110*b* provided at an outer side of the main frame 110*a* and configured to cover the outer side thereof, and a decorative frame 110*c* provided at the inner side of the main frame 110*a* which is a side opposite to the side of the cover frame 110*b*, the decorative frame functioning as a decorative material.

The main frame 110*a* may substantially serve to support the shelf 40, and is preferably formed to have strength and durability to support the shelf 40.

Each of the cover frame 110*b* and the decorative frame 110*c* may be configured to have size and shape corresponding to the main frame 110*a*.

In addition, the guide holes 120, 122, and 124 may be formed in the same manner in each of the main frame 110*a* and the decorative frame 110*c* so as to guide the movement of the shelf 40.

The decorative frame 110*c* located inside the refrigerator may be a part which is exposed to a user's eyes and is preferably made of a material that has aesthetics, such as an acrylic board.

The decorative frame 110*c* may be omitted when the main frame 110*a* has sufficient strength and durability to support the shelf 40.

As described above, the guide hole 120, 122, or 124 may include multiple guide holes formed on each of the main frame 110*a* and the decorative frame 110*c* by being formed therethrough in a left-to-right direction.

The guide holes 120, 122, and 124 are parts in which shafts to be described later are received to move, and preferably include multiple guide holes.

Specifically, the guide holes 120, 122, and 124 may include a first guide hole 120 which controls the forward/backward and upward/downward movements of a connection link 134, a second guide hole 122 which controls the forward/backward and upward/downward movements of a rear link 132 to be described later, and a shaft guide hole 124 which controls the forward/backward and upward/downward movements of the connection link 134 and the rear link 132 to be described later.

The first guide hole 120 may be formed in the lower part of the frame 110, and a first guide shaft 134*a* may be formed on the connection link 134 to be described later by protruding laterally therefrom so as to move along the first guide hole 120. That is, among the multiple guide holes 120, 122, and 124, the first guide hole 120 may be located at the lower portion of the main frame 110*a* or the decorative frame 110*c*, and may guide and control the movement of the first guide shaft 134*a* to be described later.

The second guide hole 122 may be formed in the upper portion of the frame 110, and a second guide shaft 132*a* may be formed on the rear link 132 to be described later by protruding laterally therefrom and may be installed to move along the second guide hole 122. That is, among the multiple guide holes 120, 122, and 124, the second guide hole 122 may be located at the upper portion of the main frame 110*a* or the decorative frame 110*c* and may guide and control the movement of the second guide shaft 132*a* to be described later.

The shaft guide hole 124 may be formed in the middle portion of the frame 110, and a second connection shaft 146 to be described later may be configured to move by being received in the shaft guide hole 124. That is, among the multiple guide holes 120, 122, and 124, the shaft guide hole 124 may be located at a relatively middle portion of the main frame 110*a* or the decorative frame 110*c*, that is, between the first guide hole 120 the second guide hole 122 and may guide and control the movement of the second connection shaft 146 to be described later.

Meanwhile, the guide hole 120, 122, or 124 may include a horizontal part 120*a*, 122*a*, or 124*a* formed horizontally in a front-to-rear direction, and a curvature part 120*b*, 122*b*, or 124*b* having a curvature curved gradually downward from the front end of the horizontal part 120*a*, 122*a*, or 124*a*.

Specifically, the first guide hole 120 may include a first horizontal part 120*a* configured to be parallel with the lower end of the frame 110 or the refrigerator, and a first curvature part 120*b* having a curvature downward curved gradually forward from the front end of the first horizontal part 120*a*.

In addition, the second guide hole 122 may include a second horizontal part 122*a* configured to be parallel with the lower end of the frame 110 or the refrigerator, and a second curvature part 122*b* having a curvature downward curved gradually forward from the front end of the second horizontal part 122*a*.

Furthermore, the shaft guide hole 124 may include a shaft horizontal part 124*a* configured to be parallel with the lower end of the frame 110 or the refrigerator, and a shaft curvature part 124*b* having a curvature downward curved gradually forward from the front end of the shaft horizontal part 124*a*.

The link 130, 132, or 134 may be provided on the side surface or lower side of the shelf 40 such that the shelf 40 is rotatably supported by the frame 110, and may include multiple links connected to each other.

The multiple links 130, 132, and 134 may include a front link 130 connected rotatably to the front part of the shelf 40 at an end thereof, the rear link 132 connected rotatably to the rear end part of the shelf 40 at an end thereof, and the connection link 134 connected rotatably to the rear link 132 and the front link 130 at opposite ends thereof, respectively.

Figure 3:
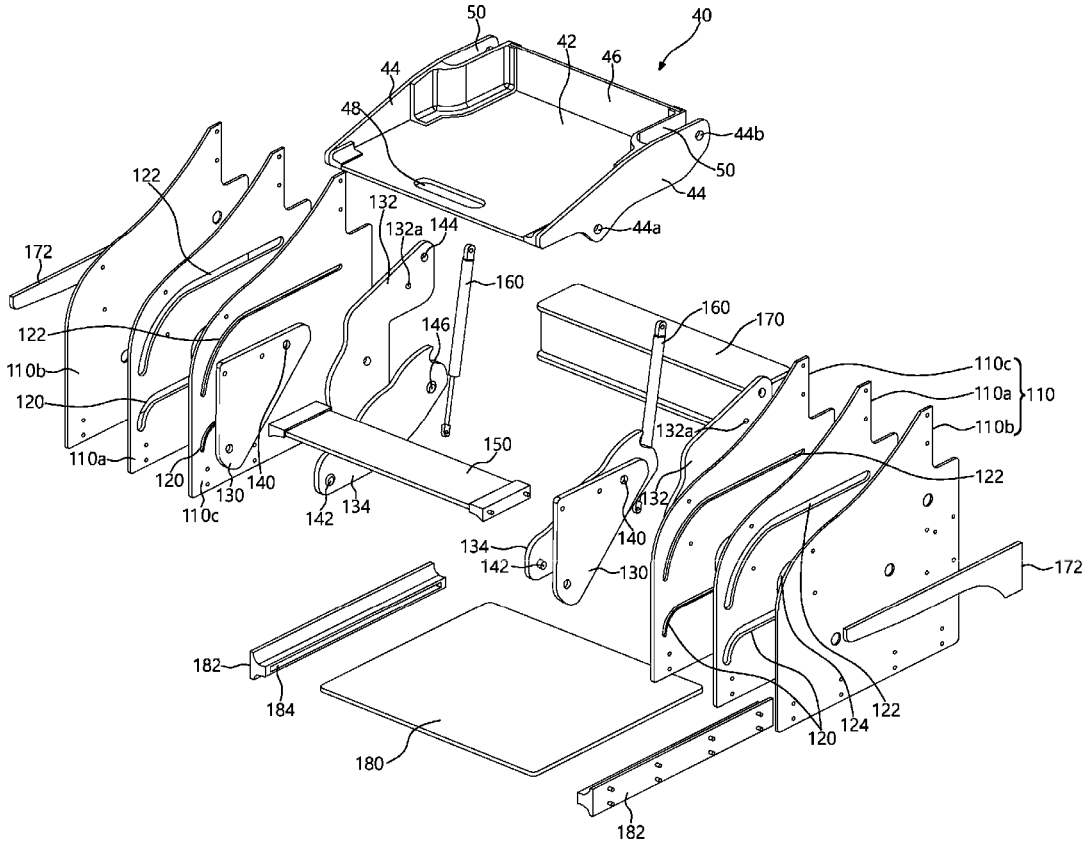
FIG. 3 is an exploded perspective view illustrating the configuration of the shelf system constituting the refrigerator according to the embodiment of the present disclosure.

The front link 130 may be intended to rotatably support the front end part of the shelf 40 and may have a triangular shape as a whole as illustrated in FIG. 3.

The first shelf shaft 140 may be inserted into and mounted to the upper end of the front link 130, and the first connection shaft 142 may be inserted into and mounted to the lower end of the front link 130.

Specifically, the first shelf shaft 140 may be inserted into and mounted fixedly or rotatably to the rear end part (in FIGS. 3 and 5) of the upper end of the front link 130. Such a first shelf shaft 140 may allow the upper end of the front link 130 and the front end of the shelf 40 to be connected rotatably to each other.

The first connection shaft 142 may be inserted into and mounted fixedly or rotatably to the lower end (in FIGS. 3 and 5) of the front link 130. Such a first connection shaft 142 may allow the lower end of the front link 130 and the front end of the connection link 134 to be connected rotatably to each other.

The front link 130 may include a pair of front links installed at the opposite sides of the front end of the shelf 40, and the pair of front links 130 may be connected to each other by a support piece 150. That is, the upper ends (in FIGS. 3 and 5) of the pair of front links 130 are preferably fixed securely to each other by the support piece 150 having a plate shape with a predetermined width.

The rear link 132 may function to rotatably support the rear end part of the shelf 40 and, as illustrated in FIG. 2, may include a pair of rear links installed at the opposite sides of the rear end of the shelf 40, and may be configured to have a predetermined vertical length.

The second shelf shaft 144 may be inserted into and mounted fixedly or rotatably to the upper end of the rear link 132 and may allow the rear end of the shelf 40 and the rear link 132 to be rotatable to each other.

The second connection shaft 146 may be mounted fixedly or rotatably to the lower end or middle part of the rear link 132 such that the rear link 132 and the connection link 134 are coupled rotatably to each other.

The second connection shaft 146 may protrude toward a side (an outer side) of each of the pair of rear links 132 and may be installed to be inserted into the shaft guide hole 124. Accordingly, the second connection shaft 146 may move upward/backward or upward/downward along the shaft guide hole 124.

The second guide shaft 132*a* may be provided at a front lower side (in FIGS. 3 and 5) of the second shelf shaft 144. The second guide shaft 132*a* may protrude toward a side (an outer side) of each of the pair of rear links 132 and may be installed to be inserted into the second guide hole 122. Accordingly, the second guide shaft 132*a* may move upward/backward or upward/downward along the second guide hole 122.

The connection link 134 may be configured to have a predetermined length in a front-to-rear direction and may allow the front link 130 and the lower end part (in FIGS. 2 to 6) of the rear link 132 to be connected rotatably to each other.

The first connection shaft 142 may be provided on the front end of the connection link 134 such that the front link 130 and the connection link 134 are connected rotatably to each other, and the second connection shaft 146 may be provided on the rear end of the connection link 134 such that the rear link 132 and the connection link 134 are connected rotatably to each other.

The first guide shaft 134*a* may be formed on the connection link 134 by protruding laterally therefrom. That is, as illustrated in FIG. FIG. 4, the first guide shaft 134*a* may be formed on the middle part of each of the pair of connection links 134 by protruding therefrom toward to outside. Such a first guide shaft 134*a* may be inserted into the first guide hole 120 and may move forward/backward or upward/downward.

Accordingly, the rotation center shaft of at least one link 130, 132, or 134 of the multiple links 130, 132, and 134 may move during the movement of the shelf 40. That is, when the shelf 40 is withdrawn forward, the first connection shaft 142 which is the rotation center shaft of the front link 130 may also be moved forward, and the second connection shaft 146 which is the rotation center shaft of the rear link 132 may also be moved forward.

The damper 160 may be provided at a side of the frame 110 such that an end of the damper 160 is connected rotatably to any one of the multiple links 130, 132, and 134. It is preferable that the damper 160 facilitates the rotation of the shelf 40 and has a locking function.

The damper 160 may be intended to further facilitate the rotation of the shelf 40, and a gas damper or a hydraulic damper is preferably used as the damper 160. The damper 160 may include a pair of dampers installed at the opposite sides of the shelf 40, but may include only one damper installed at one side of the opposite sides as required.

The damper 160 may be connected rotatably to the rear link 132 at a first end thereof and may be connected rotatably to the frame 110 at a second end thereof. That is, the damper 160 may be mounted rotatably to the upper end of the frame 110 at an upper end thereof and may be mounted rotatably to the lower end (in FIGS. 2 to 6) of the rear link 132 at a lower end thereof.

A damper fixing end 162 may be provided on the upper end of the damper 160, and a damper connection end 164 may be provided on the lower end of the damper 160.

The damper fixing end 162 may be fixed to the upper end of the main frame 110*a* or the decorative frame 110*c* and may be configured such that the damper 160 is rotatably supported.

The damper connection end 164 may be connected to the lower end (a rod end) of the damper 160 and may allow the damper 160 to be connected rotatably to the rear link 132.

It is preferable that the damper connection end 164 is composed of a connection part 164*a* connected rotatably to the damper 160 at an end thereof, and a fixed part 164*b* configured to be integrated with the connection part 164*a* and fixed to the rear link 132.

Figure 6:
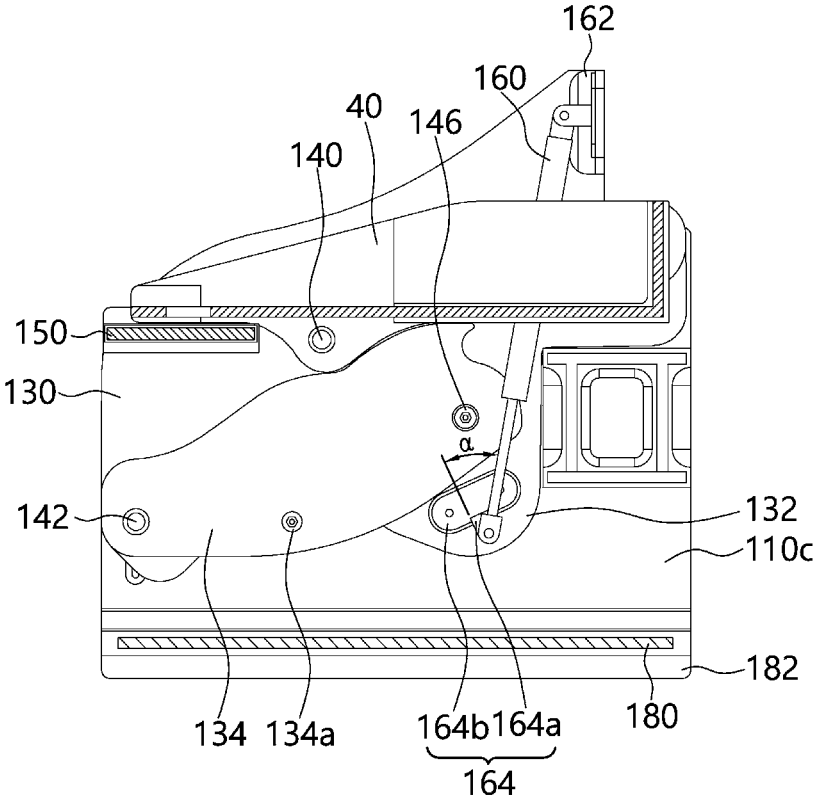
FIG. 6 is a sectional view illustrating a detailed configuration of the link while the shelf constituting the refrigerator is received in the refrigerator according to the embodiment of the present disclosure.
Figure 7:
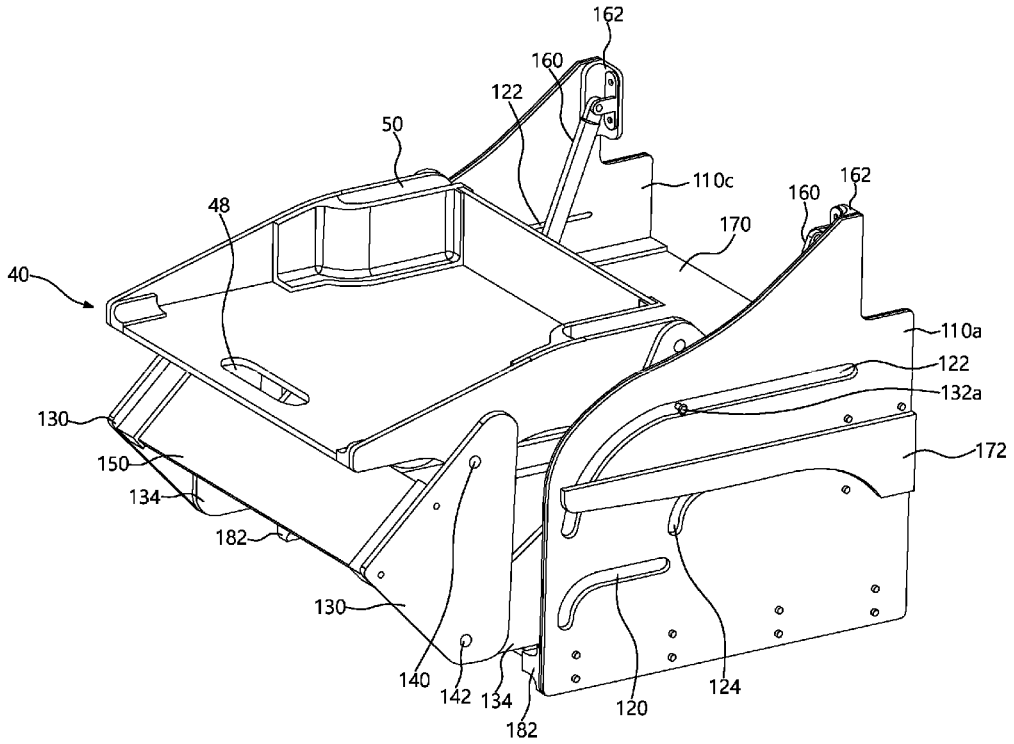
FIG. 7 is a perspective view illustrating that the shelf constituting the refrigerator is being withdrawn forward according to the embodiment of the present disclosure.

Specifically, as illustrated in FIGS. 6 and 8, the fixed part 164*b* may be configured as a plate having a predetermined length and may be fixed to the lower end part (in FIGS. 6 and 8) of the rear link 132, and the connection part 164*a* may be formed by vertically extending backward or downward from the fixed part 164*b*.

In addition, the end part of the rod of the damper 160 may be connected rotatably to the end (a lower or rear end) of the connection part 164*a*. Accordingly, the damper 160 may function to hold the rear link 132 and thus may also perform a locking function to prevent the shelf 40 from moving automatically.

For example, when the shelf 40 is received in the refrigerator, an angle α formed between the connection part 164*a* and the longitudinal direction of the damper 160 is preferably an acute angle (see FIG. 6). In this case, it is difficult to rotate the rear link 132 forward (counterclockwise in FIG. 6) relative to a lower end thereof as an axis as long as an external force of a predetermined magnitude is not applied to the rear link 132, and accordingly, the damper 160 may perform a locking function through which the present state of the shelf 40 is maintained, which makes a separate locking means unnecessary.

Figure 11:
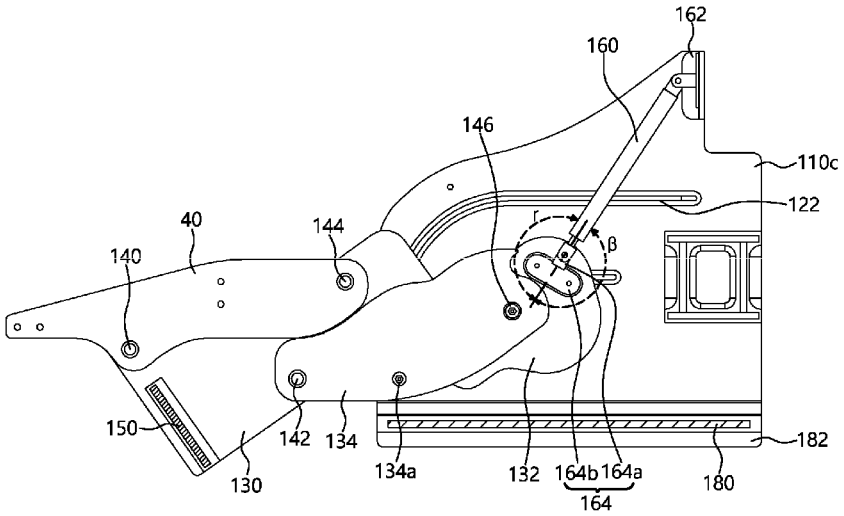
FIG. 11 is a partial sectional view illustrating the states of the link and a damper in FIG. 9.

Furthermore, when the shelf 40 is withdrawn to the front side of the refrigerator, a rear angle β formed between the connection part 164*a* and the longitudinal direction of the damper 160 is preferably smaller than a front angle γ formed therebetween (see FIG. 11). That is, it is preferable that the rear angle β formed between the connection part 164*a* and the longitudinal direction of the damper 160 is 180° or less and the front angle γ is 180° or more.

In this case, the damper 160 may apply a counterclockwise force to the rear link 132, and thus when an external force of a predetermined magnitude is not applied to the rear link 132, the withdrawn state of the shelf 40 may be maintained. Accordingly, a separate locking device for maintaining the withdrawn state of the shelf 40 may not be required.

The rear end parts of the pair of opposite frames 110 may be connected and fixed to each other by a connecting rod 170. In addition, an installation end 172 may be provided at the outer side of each of the opposite frames 110.

The installation end 172 may be provided on the cover frame 110*b* and may function to seat the shelf system 100 on a specific position inside the refrigerator.

Accordingly, the installation end 172 is preferably formed by protruding by a predetermined size from an outer side surface of the cover frame 110*b*, and may be configured to be integrated with the cover frame 110*b* or may be configured as a separate structure to be coupled to the cover frame 110*b*.

Figure 4:
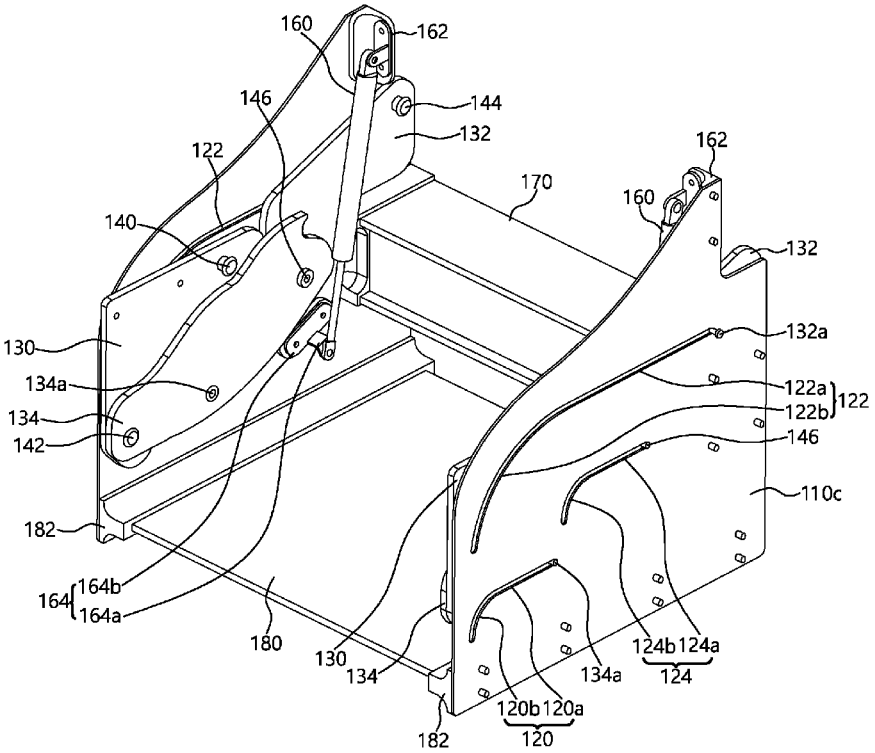
FIG. 4 is a partial perspective view illustrating the state of a link while a shelf constituting the refrigerator is received in the refrigerator according to the embodiment of the present disclosure.
Figure 5:
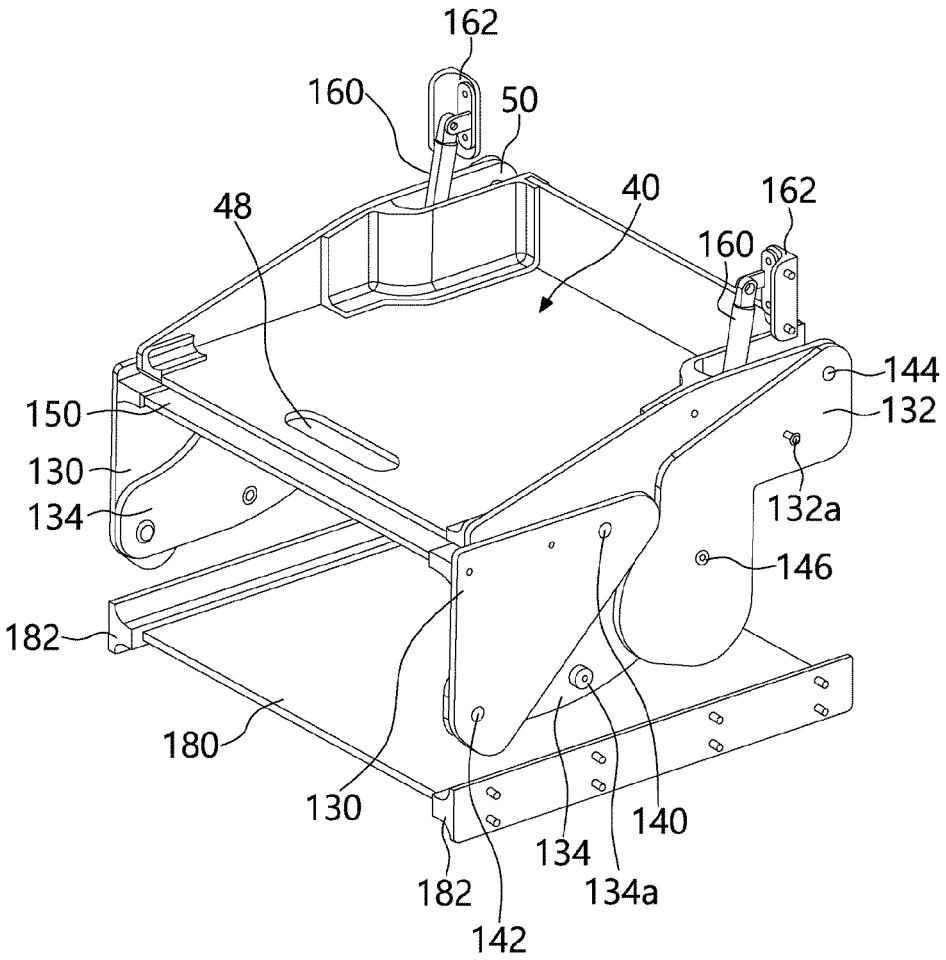
FIG. 5 is a partial perspective view illustrating the states of the link and shelf while the shelf constituting the refrigerator is received in the refrigerator according to the embodiment of the present disclosure.

Meanwhile, an auxiliary shelf 180 may be provided on the lower end of the pair of frames 110. As illustrated in FIG. 4, the auxiliary shelf 180 is preferably configured as a rectangular plate and may be supported by a side support end 182 located at each of the opposite sides of the auxiliary shelf.

The side support end 182 may include a pair of side support ends, and may be mounted fixedly to the inner surface of the frame 110, wherein the side support ends 182 may be configured to be symmetrical to each other in a horizontal direction. Accordingly, a shelf groove 184 into which the auxiliary shelf 180 is inserted to be fitted may be formed in a side surface of each of the pair of side support ends 182 facing each other.

Hereinafter, the operation of the refrigerator having the above configuration according to the present disclosure will be described by focusing on the shelf system with reference to the accompanying drawings.

First, while the shelf 40 is received in the refrigerator, the shelf 40 may be in states thereof illustrated in FIGS. 2, 4, 5, and 6.

In this case, as illustrated in FIG. 6, the angle α between the connection part 164*a* and the longitudinal direction of the damper 160 may be an acute angle, and thus it is difficult to rotate the rear link 132 forward (counterclockwise in FIG. 6) relative to the lower end thereof as an axis, so as long as an external force of a predetermined magnitude is not applied to the rear link 132, the stationary state of the rear link may be maintained.

In addition, the first guide shaft 134*a* may be located at the rear end of the first guide hole 120, the second connection shaft 146 may be located at the rear end of the shaft guide hole 124, and the second guide shaft 132*a* may be located at the rear end of the second guide hole 122.

In this state, when a user pulls the shelf 40 forward (toward the left side in FIG. 6) by holding the handle 48, the damper 160 may contract, and the shelf 40 may be withdrawn forward (toward the left side in FIG. 6).

The upper end part of each of the front link 130 and the rear link 132 may be connected to the shelf 40, and accordingly, when the shelf 40 is withdrawn forward, each of the front link 130 and the rear link 132 may be rotated counterclockwise (in FIG. 6) relative to a lower end thereof as an axis. That is, the front link 130 may be rotated relative to the first connection shaft 142, and the rear link 132 may be rotated relative to the second connection shaft 146.

Of course, in this case, the upper end parts of the front link 130 and the rear link 132 may move forward, and at the same time, the lower parts thereof may also move forward. That is, the first connection shaft 142 and the second connection shaft 146 which respectively are the rotation centers of the front link 130 and the rear link 132 may also move forward.

The first guide shaft 134*a* may move forward along the first guide hole 120, the second connection shaft 146 may move forward along the shaft guide hole 124, and the second guide shaft 132*a* may move forward along the second guide hole 122.

A state in which the shelf 40 moves forward as described above is illustrated in FIGS. 7 and 8. As illustrated herein, the front-to-rear length of each of the shaft guide hole 124 and the first guide hole 120 may be shorter than the front-to-rear length of the second guide hole 122. Accordingly, when the second guide shaft 132*a* reaches the front end part of the first horizontal part 120*a* of the second guide hole 122, the first guide shaft 134*a* may reach the front end of the first guide hole 120, and the second connection shaft 146 may reach the front end of the shaft guide hole 124.

When the first guide shaft 134*a* and the second connection shaft 146 reach the front ends of the first guide hole 120 and the shaft guide hole 124, respectively, the connection link 134 may not move or rotate any longer, and the front link 130 may just rotate counterclockwise (see FIGS. 7 and 8) relative to the first connection shaft 142, and the rear link 132 may also just rotate counterclockwise (see FIGS. 7 and 8) relative to the second connection shaft 146.

Accordingly, the shelf 40 may move downward while moving forward, and the second guide shaft 132*a* may move along the second curvature part 122*b* of the second guide hole 122 and may reach the front end of the second guide hole 122.

Figure 10:
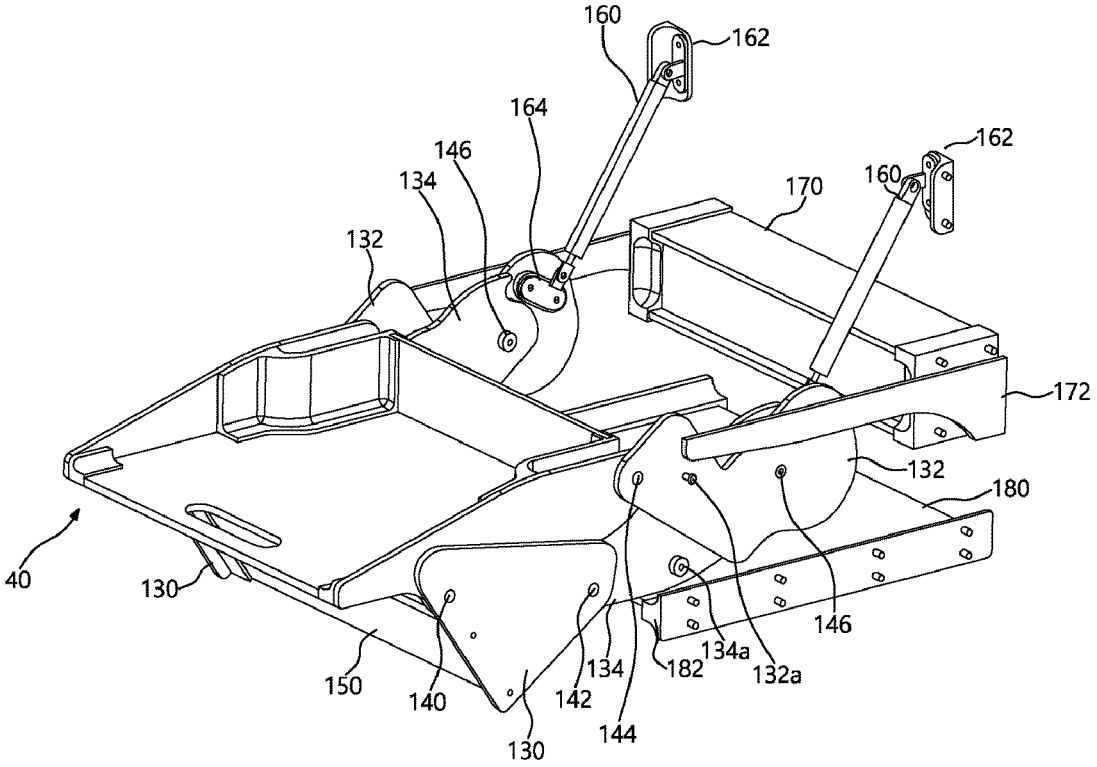
FIG. 10 is a partial perspective view illustrating the states of the link and the shelf in FIG. 9.

When the second guide shaft 132*a* reaches the front end of the second guide hole 122, the shelf 40 may be completely withdrawn forward, and in this case, the states of the shelf 40 and each of the links 130, 132, and 134 are illustrated in FIGS. 9 to 11.

In this case, the additional forward movement of the shelf 40 by the rear link 132 may be prevented, and the damper 160 may prevent the rear link 132 from automatically rotating clockwise.

Specifically, as illustrated in FIG. 11, when the shelf 40 is completely withdrawn to the front side of the refrigerator, the rear angle β formed between the connection part 164*a* and the longitudinal direction of the damper 160 may be smaller than the front angle γ formed therebetween. That is, the rear angle β formed between the connection part 164*a* and the longitudinal direction of the damper 160 may be 180° or less, and the front angle γ may be 180° or more. Accordingly, as long as the front end part (a left end in FIG. 11) of the rear link 132 is not pushed up, the rear link 132 may not be rotated clockwise, so the withdrawn state of the shelf 40 may be stably maintained.

In order to restore the shelf 40 withdrawn forward by this process to an initial position, the front end part (the left end in FIG. 11) of the shelf 40 may be pushed backward while being raised upward. In this case, the front link 130, the rear link 132, and the connection link 134 may be received inside the refrigerator in a reverse order to the order of the withdrawal of the shelf 40 described above.

The scope of the present disclosure is not limited to the embodiment illustrated above, and many other modifications based on the present disclosure will be possible for those skilled in the art within the above technical scope.

For example, in the embodiment described above, the frame 110 is illustrated to include the main frame 110*a*, the cover frame 110*b*, and the decorative frame 110*c*, but may include only the main frame 110*a* or may include only the main frame 110*a* and the cover frame 110*b*.

The invention claimed is:

1. A refrigerator comprising:

a main body having at least one storage space defined therein;

a door mounted rotatably to a front surface of the main body and configured to shield the storage space defined inside the main body;

a shelf provided inside the main body and configured to store food; and a shelf system that movably supports the shelf, wherein the shelf system is configured to, during withdrawal of the shelf, enable the shelf to move forward and downward while the shelf being rotated downward by the shelf system, wherein the shelf system comprises:

a frame that supports the shelf and is detachably attached to the main body, and multiple links disposed at one side of the shelf and configured to support the shelf, wherein the multiple links enable the shelf to move forward and backward relative to the frame, to move upward and downward relative to the frame, or to rotate relative to the frame, wherein the frame defines a plurality of guide holes that define a trajectory of movement of at least one link of the multiple links, the plurality of guide holes comprising a first guide hole, a second guide hole, and a shaft guide hole, and wherein a front-to-rear length of each of the first guide hole and the shaft guide hole is shorter than a front-to-rear length of the second guide hole.

2. The refrigerator of claim 1, wherein a rotation center shaft of a link among the multiple links that supports the shelf is configured to move during a movement of the shelf.

3. The refrigerator of claim 1, wherein a rotation center shaft of at least one link of the multiple links is configured to move based on the shelf moving along at least one of the plurality of guide holes.

4. The refrigerator of claim 3, further comprising:

a damper provided at a side of the frame and connected rotatably to any one of the multiple links at an end of the damper, the damper being configured to facilitate rotation of the shelf and providing a locking function.

5. The refrigerator of claim 4, wherein the multiple links comprise:

a front link connected rotatably to a front part of the shelf at an end thereof;

a rear link connected rotatably to a rear end part of the shelf at an end thereof; and a connection link connected rotatably to the rear link and the front link at opposite ends thereof.

6. The refrigerator of claim 5, wherein:

the first guide hole controls forward/backward and upward/downward movements of the connection link;

the second guide hole controls forward/backward and upward/downward movements of the rear link; and the shaft guide hole controls the forward/backward and upward/downward movements of the connection link and the rear link.

7. The refrigerator of claim 6, wherein the multiple links further comprise:

a first connection shaft that is provided at a front end of the connection link and that rotatably connects the front link and the connection link to each other; and a second connection shaft that is provided at a rear end of the connection link and that rotatably connects the rear link and the connection link to each other.

8. The refrigerator of claim 7, wherein the damper is connected rotatably to the rear link at a first end thereof, and is connected rotatably to the frame at a second end thereof.

9. The refrigerator of claim 8, wherein a damper connection end is provided on the first end of the damper such that the damper is connected rotatably to the rear link, the damper connection end comprising a connection part connected rotatably to the damper at an end thereof, and a fixed part configured to be integrated with the connection part and fixed to the rear link.

10. The refrigerator of claim 9, wherein the shelf is configured to:

based on being received in the main body, define an acute angle between the connection part and a longitudinal direction of the damper; and based on being withdrawn toward a front side of the refrigerator, define a rear angle between the connection part and the longitudinal direction of the damper, the rear angle being less than a front angle defined between the connection part and the longitudinal direction of the damper.

11. The refrigerator of claim 1, wherein the plurality of guide holes are defined at different heights of the frame, and wherein the second guide hole is defined above the first guide hole and the shaft guide hole, and the shaft guide hole is defined between the first guide hole and the second guide hole.

12. The refrigerator of claim 11, wherein a front end portion of each of the plurality of guide holes is curved downward.

13. The refrigerator of claim 11, wherein the first guide hole is defined forward relative to the shaft guide hole.

14. The refrigerator of claim 11, wherein the second guide hole extends forward relative to the shaft guide hole.

15. The refrigerator of claim 11, wherein the second guide hole extends rearward relative to the shaft guide hole.

16. The refrigerator of claim 11, wherein a rear end of the second guide hole disposed rearward relative to rear ends of the first guide hole and the shaft guide hole, and wherein the rear end of the first guide hole is disposed forward relative to a front end of the shaft guide hole.

* * * * *